US009346300B2

(12) United States Patent
Suzuki

(10) Patent No.: US 9,346,300 B2
(45) Date of Patent: May 24, 2016

(54) INKJET PRINTER

(71) Applicant: OKI DATA INFOTECH CORPORATION, Chiba-shi, Chiba (JP)

(72) Inventor: Kenji Suzuki, Chiba (JP)

(73) Assignee: Oki Data Infotech Corporation, Chiba-shi, Chiba (JP)

( * ) Notice: Subject to any disclaimer, the term of this patent is extended or adjusted under 35 U.S.C. 154(b) by 0 days.

(21) Appl. No.: 14/647,349

(22) PCT Filed: Oct. 23, 2013

(86) PCT No.: PCT/JP2013/078655
§ 371 (c)(1),
(2) Date: May 26, 2015

(87) PCT Pub. No.: WO2014/119062
PCT Pub. Date: Aug. 7, 2014

(65) Prior Publication Data

US 2015/0321494 A1 Nov. 12, 2015

(30) Foreign Application Priority Data

Feb. 1, 2013 (JP) ..... 2013-018755

(51) Int. Cl.
*B41J 29/377* (2006.01)
*B41J 2/01* (2006.01)
*B41J 11/00* (2006.01)

(52) U.S. Cl.
CPC *B41J 29/377* (2013.01); *B41J 2/01* (2013.01); *B41J 11/002* (2013.01)

(58) Field of Classification Search
USPC ..... 347/18, 102, 103
See application file for complete search history.

(56) References Cited

U.S. PATENT DOCUMENTS

| | | | | |
|---|---|---|---|---|
| 7,558,060 | B2 * | 7/2009 | Kiyosumi | B41J 29/377 165/80.3 |
| 8,845,066 | B2 * | 9/2014 | Domae | 347/18 |
| 2004/0096229 | A1 * | 5/2004 | Yoshihara et al. | 399/33 |
| 2011/0199448 | A1 * | 8/2011 | Kaiho et al. | 347/102 |
| 2013/0328963 | A1 * | 12/2013 | Domae | 347/18 |

FOREIGN PATENT DOCUMENTS

JP 2006 264328 10/2006

OTHER PUBLICATIONS

International Search Report mailed Jan. 21, 2014 issued in International Appln. No. PCT/JP2013/078655.

* cited by examiner

*Primary Examiner* — Matthew Luu
*Assistant Examiner* — Lily Kemathe
(74) *Attorney, Agent, or Firm* — Muncy, Geissler, Olds & Lowe, P.C.

(57) ABSTRACT

An inkjet printer records an image on a recording medium by ejecting ink onto the recording medium from a recording head mounted on a carriage. A housing suction fan is arranged on a rear surface of the housing for sucking a gas from an outside into an inside of the housing. A carriage suction fan is arranged on the rear surface of the housing opposite to the housing suction fan for sucking into the carriage the gas sucked by the housing suction fan. A rear surface exhaust fan and a side surface exhaust fan are arranged on the rear surface and a side surface, respectively, of the housing for exhausting the gas inside the housing to the outside. The gas sucked by the housing suction fan is sucked into the carriage by the carriage suction fan and flows into the housing without being sucked by the carriage suction fan.

18 Claims, 3 Drawing Sheets

INKJET PRINTER

BACKGROUND OF THE INVENTION

1. Technical Field

The present invention relates to an inkjet printer.

2. Background Art

There is known an inkjet printer for recording an image or the like by ejecting ink onto a recording medium, such as recording paper and a resin film. In the inkjet printer, various types of inks are used. Examples of the inks include solvent ink using an organic solvent as a prime solvent, ultraviolet curable ink that is curable due to ultraviolet radiation, and thermosetting ink that is curable due to heat. The various types of inks are used depending on intended use.

In recent years, there has been a strong demand to promptly shift to a next work process, such as lamination so as to protect a printed surface after printing and cutting of a printed product into a desired size after the printing, thereby growing the demand to quickly dry the ink. To meet those demands, methods utilizing properties of inks, such as the ultraviolet curable ink and the thermosetting ink, are examined.

On the other hand, the solvent ink using the organic solvent as the prime solvent is excellent in fixability onto a resin film such as a PVC film, thereby achieving an advantage in that a recorded product that is highly resistant to wear can be obtained. It is desired to enhance a drying property of this type of ink. To enhance fixability onto the recording medium, this type of ink is ejected under a state in which the recording medium is moderately heated, and also after the recording, the recording medium is moderately heated in order to quickly dry the solvent. For example, a platen, a paper guide provided on a front side of the platen, and a paper guide provided on a rear side of the platen are each heated, and owing to the heat, the recording medium may be heated. A recording head is also heated, and further the recording head itself generates heat. On the other hand, when the temperature of the recording head or the ink is changed, the viscosity of the ink is changed accordingly, which adversely affects the ejection performance and the image quality. Thus, it is necessary to moderately cool the recording head and the ink.

For example, in JP 2006-264328 A, there is disclosed an inkjet printer using the thermosetting ink that promotes fixing due to heat. This device has a structure in which a heater is arranged above the carriage so as to extend along the scanning direction of the carriage. Therefore, the carriage is considerably heated, and hence is required to be cooled. The flow of the air is forcibly formed so as to cool the carriage by the air.

CITATION LIST

Patent Literature

[PTL 1] JP 2006-264328 A

The technology described in JP 2006-264328 A is a technology of a method involving applying heat to the ink and the recording medium immediately after the ink is ejected from an ink jet head in order to efficiently dry the ink. This type of method is also applicable to the solvent ink. However, in this case, the heater is arranged immediately above the ink jet head. In such a structure, the carriage including the ink jet head is heated immediately below the heater. Therefore, the temperature of the ink jet head is increased, thus leading to ejection failure. Therefore, in JP 2006-264328 A, there is disclosed a structure in which cooling fans are arranged in parallel to the heater, and the air is blown onto the carriage so as to cool the carriage. Further, an air guide is provided on the carriage so as to easily receive the air. Still further, the cooling fans are installed on both ends of the carriage so that the air flows from a center side of the carriage to both the end sides thereof. Yet further, there are disclosed a system in which the carriage is cooled by cooling water and a structure in which a heat-resistant plate for reflecting light is arranged on top of the carriage. In this manner, the temperature of the carriage is prevented from increasing. In such a case, when the cooling water or the heat-resistant plate is used, there is a problem in that an extra space is required and further the cost increases.

Further, the fans are fixed above the carriage so as to face the recording medium. A discharge port for the sucked air is common to a delivery port for the recording medium, and hence there is a fear in that the air is sent to the recording medium immediately before and after the printing so that the recording medium is excessively cooled. There is also a fear in that the temperature of the recording medium is decreased to cause fixing unevenness of the ink landing on the recording medium, or that the air flows around a nozzle surface of the inkjet head to cause ejection failure. The simple generation of air is not fully appropriate.

SUMMARY OF THE INVENTION

According to one embodiment of the present invention, there is provided an inkjet printer for recording an image on a recording medium by ejecting ink onto the recording medium from a recording head while intermittently conveying the recording medium, the inkjet printer including: a recording head having a plurality of nozzles, for ejecting ink onto a recording medium from the plurality of nozzles; a carriage having the recording head mounted therein, the carriage being reciprocable in a direction intersecting with a conveyance direction of the recording medium; a platen for retaining the recording medium, the platen being arranged so as to be opposed to a lower surface side of the carriage; a heater provided in the platen, for heating the recording medium; conveyance means for conveying the recording medium; a housing having at least the carriage accommodated therein; housing-suction means for sucking a gas from an outside into an inside of the housing, the housing-suction means being arranged on a rear surface of the housing so as to be opposed to a rear surface of the carriage; first exhaust means for exhausting the gas inside the housing to the outside, the first exhaust means being arranged on the rear surface of the housing; second exhaust means for exhausting the gas inside the housing to the outside, the second exhaust means being arranged on a side surface of the housing; carriage-suction means for sucking the gas, which is sucked by the housing-suction means, into the carriage, the carriage-suction means being arranged on the rear surface of the carriage so as to be opposed to the housing-suction means; a front paper guide for guiding and heating the recording medium, the front paper guide being arranged on a downstream side of the platen in the conveyance direction; and a cover arranged at a distance from the front paper guide and connected to the housing so that a distal end portion thereof is positioned lower in a vertical direction than a surface of the recording head, on which the plurality of nozzles are arranged, in which the housing-suction means has a height along the vertical direction, which is larger than a height of the carriage-suction means along the vertical direction, in which, when the housing-suction means and the carriage-suction means are arranged at positions opposed to each other, the gas sucked by the housing-suction means is sucked into the carriage by the carriage-suction means, and flows into the housing without being sucked by the carriage-suction means, in which the gas, which is sucked into the carriage by the carriage-suction means, is discharged to the inside of the housing toward the cover, and in which the gas sucked by the housing-suction means is at least discharged to the outside of the housing from the first exhaust means, the second exhaust means, and a clearance between the front paper guide and the cover.

The outside air taken by the device is taken into the carriage. Thus, the temperature inside the carriage is prevented from increasing, and the outside air not taken into the carriage cools the entire device. Further, the exhaust fan discharges the gas to the outside, and hence the recording medium is not cooled in a concentrated manner. Thus, the temperature of the ink immediately after the landing can be prevented from decreasing, and the drying can be promoted by moderately blowing air onto the recording medium after the printing. In addition, the air less flows around the nozzle surface of the recording head, thereby preventing reduction of ink landing accuracy, increase of ink mist, and drying of the nozzles.

DETAILED DESCRIPTION OF THE INVENTION

An embodiment of the present invention is described with reference to the drawings.

Figure 1:
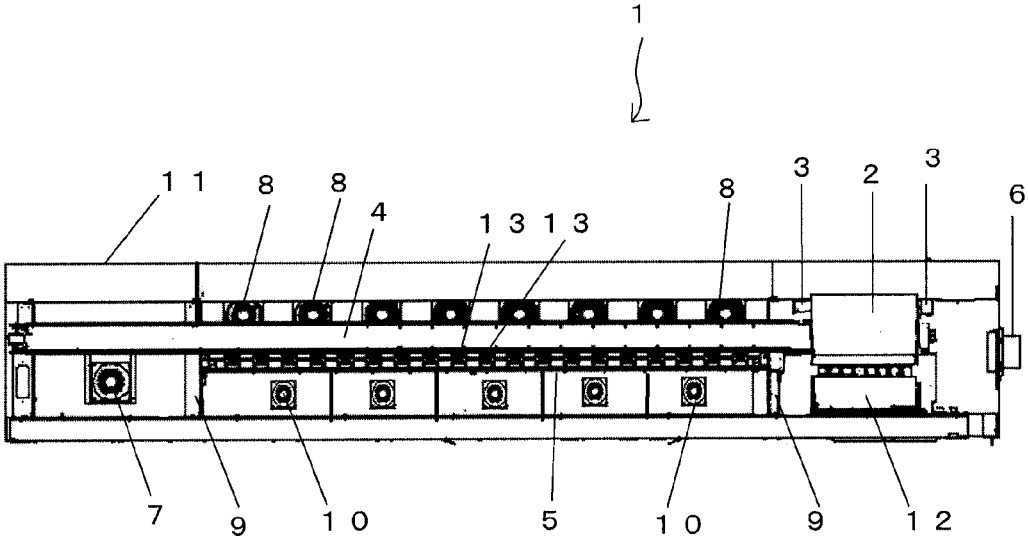
FIG. 1 is an explanatory view of arrangement of suction means and exhaust means in an inkjet printer.

FIG. 1 is an explanatory view of the arrangement of suction means and exhaust means in an inkjet printer. A large number of housing-suction fans (first suction fans) 8 serving as housing-suction means for sucking a gas are provided in a rear surface of a housing 11 of an inkjet printer 1. The housing-suction fans 8 are arranged along a longitudinal direction of the housing 11. The housing-suction fans 8 suck an outside gas, that is, air into the housing 11.

A Y rail 4 and a platen 5 are also arranged along the longitudinal direction of the housing 11. The platen 5 is a flat platen, and a large number of through holes are formed therein. Below the platen 5, there is secured a space partitioned by the platen 5, erecting plates 9 provided below both ends of the platen 5, and the like. A gas in the space is discharged to the outside through a large number of suction fans 10 so as to generate negative pressure, and a recording medium conveyed on the platen 5 is sucked so as to be fixed. The gas is exhausted by the suction fans 10 from a part below a front paper guide described later. Further, the suction fans 10 are also arranged along the longitudinal direction of the housing 11. A carriage 2 movable along the Y rail 4 is provided. The carriage 2 has recording heads described later mounted therein, and is reciprocable along the Y rail 4. The recording head includes a large number of nozzles so as to eject ink.

A large number of conveyance rollers 13 for conveying the recording medium are provided on an upstream side of the platen 5 along the conveyance direction of the recording medium. The conveyance rollers 13 are arranged along a longitudinal direction of the platen 5 at equal intervals. A maintenance unit 12 for the recording heads is provided on one end of the housing 11. The maintenance unit 12 includes a wiper for wiping a nozzle surface of the recording head, and a cap for sucking ink while being held in close contact with the nozzle surface. The maintenance unit 12 performs maintenance such as cleaning the recording heads, covering the recording heads with the caps when not in use so as to prevent drying of the nozzle surface, and sucking the ink when the nozzles are clogged so as to recover the nozzles.

A housing side surface-exhaust fan (second exhaust fan) 6 is provided on a side surface of the housing 11 on the maintenance unit 12 side so as to exhaust the gas inside the housing 11 to the outside. Further, a space for turning when the carriage 2 reciprocates is secured on a side of the housing 11, which is opposite to the housing side surface-exhaust fan 6 across the platen 5. A housing rear surface-exhaust fan (first exhaust fan) 7 is provided on the rear of the space, that is, the rear surface of the housing 11 so as to exhaust the gas inside the housing 11 to the outside.

The maintenance unit 12 is provided on the housing side surface-exhaust fan 6 side, and hence the volume of a space in the housing 11 on the housing side surface-exhaust fan 6 side is smaller than the volume of the space in the housing 11 on the housing rear surface-exhaust fan 7 side. Therefore, the fans for exhausting the gas are respectively provided on the side surface on the side having the smaller volume and on the rear surface on the side having the larger volume. The flow degree of the gas is equalized as much as possible so that a difference in air resistance in the moving direction when the carriage 2 is moved is reduced. An adverse effect on the image quality caused in the moving direction is reduced.

Ducts 3 for sucking a gas from an outside into the carriage 2 are respectively formed on both ends of an upper part of the carriage 2. The duct 3 has a fan and sucks the gas through the fan. The ducts 3 are arranged so as to be reciprocable in a position at a height at which the housing-suction fans 8 are arranged. An outside air sucked by the housing-suction fans 8 can be sucked into the ducts 3 for the purpose of cooling the inside of the carriage by cool air through the suction of the air before the air becomes warmer inside the housing 11.

Figure 2:
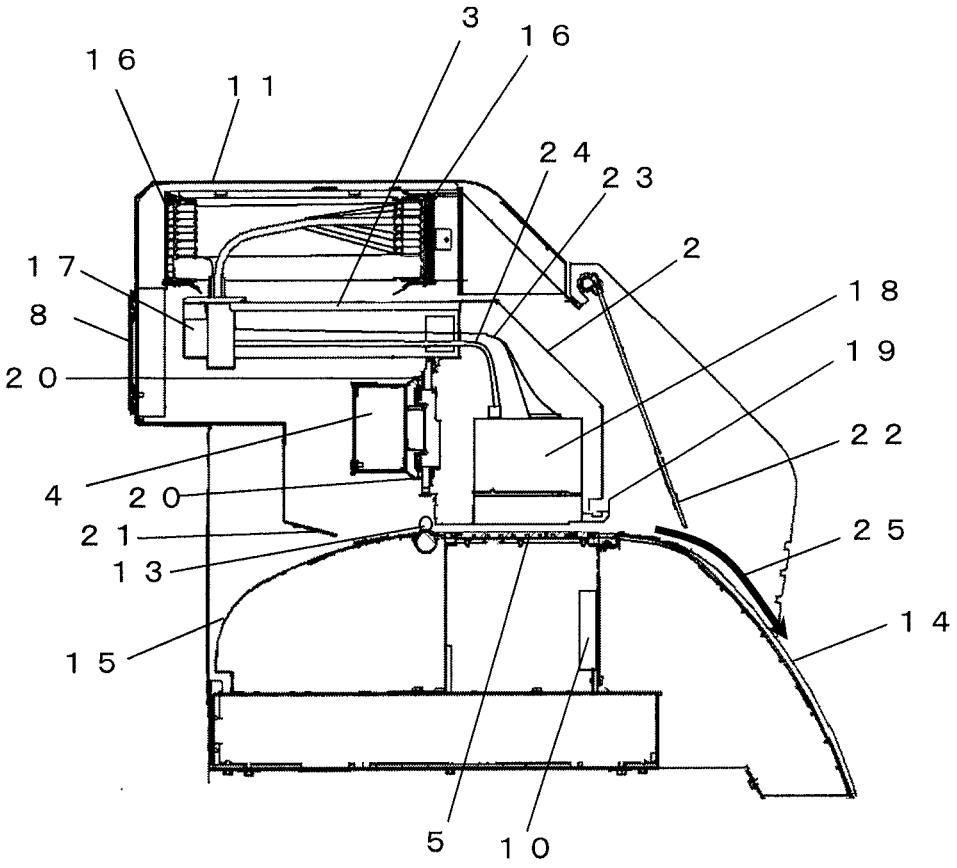
FIG. 2 is a sectional view of the inkjet printer.

FIG. 2 is a sectional view of the inkjet printer. The housing-suction fan 8 has a height in a vertical direction larger than a height in the vertical direction of each carriage-suction fan (second suction fan) 17, which is approximately twice as large as the height in the vertical direction of the carriage-suction fan 17. As the housing-suction fan 8, a large-sized fan is used so as to suck a large amount of the outside air. The gas sucked into the housing 11 includes a gas to be sucked into the carriage 2 by the carriage-suction fans 17 and a gas to pass through the outside of the carriage 2. The carriage-suction fans 17 are arranged at distal ends of the ducts 3 so as to be opposed to the housing-suction fans 8. With this, fresh outside air can be guided into the ducts 3 so as to cool the inside of the carriage 2.

The carriage 2 has recording heads 18 mounted therein. A plurality of the recording heads 18 are arranged in a depth direction in the drawing sheet.

The carriage 2 has an discharge port 19 formed in a lower part of a front surface thereof so that the air sucked into the carriage 2 flows toward a cover 22 arranged on a front surface of the housing 11. The discharge port 19 is formed along the moving direction of the carriage 2 so as to have a width corresponding to an arrangement position of the recording heads 18. The discharge port 19 has an elongated hole shape, which is an elongated hole having a width corresponding to an inside dimension of the carriage 2 in a width direction thereof at the maximum.

A flat cable 23 and an ink tube 24 are connected to an upper part of the recording head 18. The flat cables 23 and the ink tubes 24 respectively extend through the two ducts 3 so as to be directed upward in the vicinity of the carriage-suction fans 17, thereby entering a tube accommodating portion 16. The tube accommodating portion 16 accommodates the flat cables 23 and the ink tubes 24 so as to be bent into a U-shape in order to connect the flat cables 23 and the ink tubes 24 extending respectively from a control circuit board and ink tanks arranged in other locations of the housing 11 to the recording heads 18 mounted in the reciprocable carriage 2. Further, an air-flow from the ducts 3 are separated into an upper side and a lower side by the flat cables 23 and the ink tubes 24 so as to cool the inside of the carriage 2. The air-flow inside the carriage 2 is separated, and thus reflux is less likely to occur between the upper side and the lower side. In this manner, the gas that stagnates inside the carriage 2 can be reduced, with the result that the cooling can be carried out suitably.

The tube accommodating portion 16 is arranged above the carriage-suction fans 17 and the housing-suction fans 8, and thus the air-flow, which is generated through the suction by the housing-suction fans 8, is not disturbed by the flat cables 23 and the ink tubes 24, with the result that a stable air-flow can be generated. The flat cables 23 and the ink tubes 24 are moved along with the movement of the carriage 2, which has been a cause of disturbing the air-flow.

A roller 20 is provided on a rear surface side of the carriage 2 and is connected to the Y rail 4. A front paper guide 14 is provided on a downstream side of the platen 5 along the conveyance direction of the recording medium, and a rear paper guide 15 is provided on the upstream side thereof. The conveyance rollers 13 are arranged in a portion between the rear paper guide 15 and the platen 5. The recording medium is heated in the rear paper guide 15, and conveyed while being nipped by the conveyance rollers 13. Then, the recording medium is sent to the platen 5, and further delivered along the front paper guide 14. A heater is also provided in each of the platen 5 and the front paper guide 14 so as to heat the recording medium. In this manner, drying of ink adhered to the recording medium is promoted.

The rear paper guide 15 is opposed to a bending portion 21, which is arranged above the rear paper guide 15 and corresponds to a portion at which an end portion of the housing 11 is bent. The bending portion 21 is bent toward an inward direction of the housing 11, and further approaches the rear paper guide 15 toward a distal end thereof. Further, the distal end portion of the bending portion 21 is arranged so as to be lower than a flat portion on a surface of the platen 5 in a vertical direction. With this, the gas sucked by the housing-suction fans 8 easily flows, even in a small amount, toward the downstream side in the conveyance direction of the recording medium, that is, toward the carriage 2 or the cover 22. In other words, the sucked air is difficult to flow out from the bending portion 21.

The front paper guide 14 is opposed to a distal end of the cover 22 provided above the front paper guide 14. The cover 22 is connected to the housing 11 in a pivotable manner. Further, the cover 22 approaches the front paper guide 14 toward a distal end thereof. The front paper guide 14 has a curved surface curved downward toward the downstream side in the conveyance direction of the recording medium. With the cover 22 and the front paper guide 14 configured as described above, the gas inside the housing 11 easily flows along a surface of the front paper guide 14. The heater is provided inside the front paper guide 14, and the recording medium is heated by the heater, to thereby promote the drying of the ink adhered to the recording medium. In this case, when a solvent that evaporates in the vicinity of a surface of the recording medium stagnates, the drying of the ink is inhibited. Therefore, the stagnation of the solvent is prevented by sending air. The cover 22 is arranged gradually closer to the front paper guide 14 toward the distal end of the cover 22 so as to form an air-flow along the front paper guide 14 in a direction indicated by the arrow 25. Further, the front paper guide 14 is arranged so as to be curved downward.

Further, the gas discharged from the discharge port 19 is directed to the cover 22. The gas blown onto the cover 22 forms an air-flow along the cover 22 in a downward direction, and further flows along the front paper guide 14. The gas exhausted from the discharge port 19 is discharged to the outside while being mixed with a gas flowing through the outside of the carriage 2. It is preferred that the gas sucked by the carriage-suction fans 17 flow faster than the gas flowing through the outside of the carriage 2 when discharged from the discharge port 19. Along with the air-flow from the discharge port 19, a gas surrounding the air-flow also flows faster, and hence the gas can be smoothly discharged from a portion between the front paper guide 14 and the cover 22 to the outside. It is possible to promote the discharge of the solvent having evaporated into the gas from the ink stagnating in the housing, and hence the ink can be dried in a shorter period of time. Further, the solvent having evaporated into the gas from the ink stagnating in the vicinity of the surface of the front paper guide 14 can be eliminated.

The gas sucked into the housing 11 is discharged mainly from the housing side surface-exhaust fan 6, the housing rear surface-exhaust fan 7, a portion between the rear paper guide 15 and the bending portion 21, or a portion between the front paper guide 14 and the cover 22, or through the suction by the platen 5. The gas is discharged not only in a specific direction but also in various directions in the device so as not to cool only a specific location or cause the strong air to blow onto the specific location, but generate air-flows that flow out in the various directions.

Figure 3:
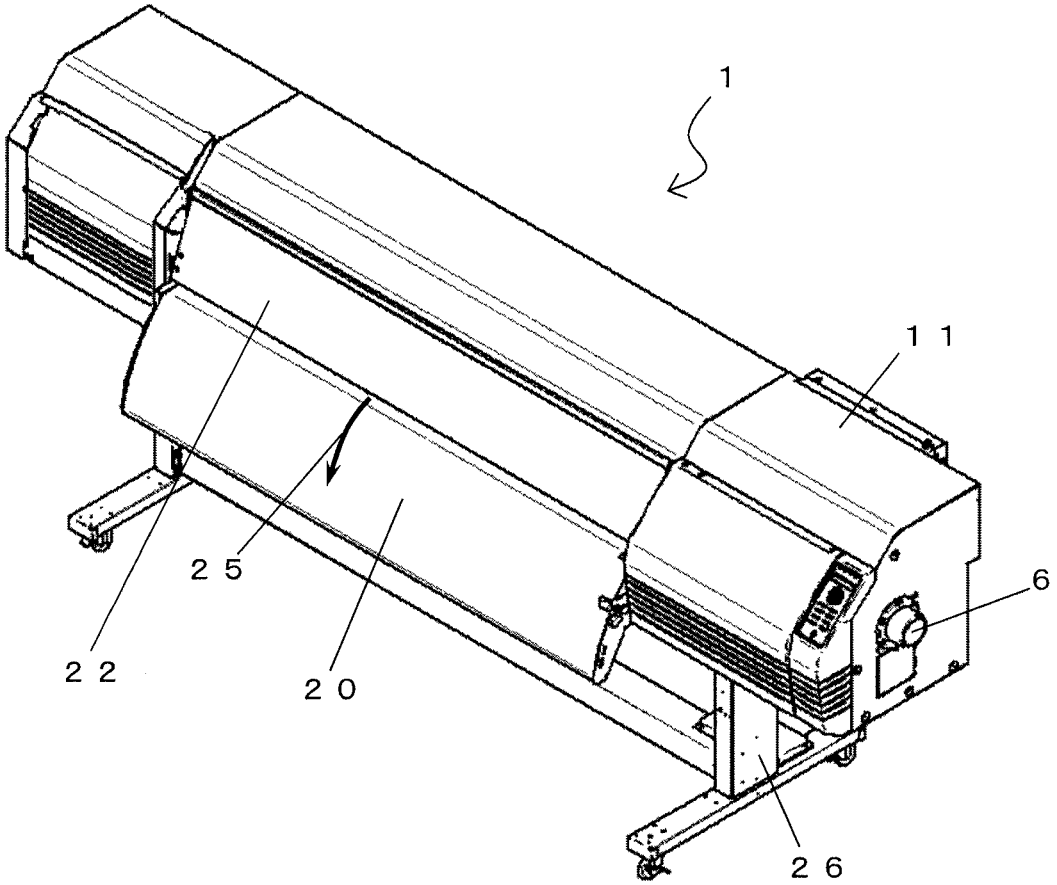
FIG. 3 is an external view of the inkjet printer.

FIG. 3 is an external view of the inkjet printer. In the inkjet printer 1, the housing 11 is supported by legs 26. The legs 26 are fixed to both ends of a lower surface of the housing 11. The front paper guide 20 is arranged at a position as high as possible so as to reduce an adverse effect of a floor on the air-flow indicated by the arrow 25.

INDUSTRIAL APPLICABILITY

The present invention is applicable to an inkjet printer, and particularly applicable to a large-sized inkjet printer.

REFERENCE SIGNS LIST

1 inkjet printer
2 carriage
3 duct
4 Y rail
5 platen
6 housing side surface-exhaust fan
7 housing rear surface-exhaust fan
8 housing-suction fan
9 erecting plate
10 suction fan
11 housing
12 maintenance unit
13 conveyance roller
14 front paper guide
15 rear paper guide
16 tube accommodating portion
17 carriage-suction fan
18 recording head
19 discharge port
20 roller
21 bending portion
22 cover

23 flat cable

24 ink tube

The invention claimed is:

1. An inkjet printer for recording an image on a recording medium by ejecting ink onto the recording medium from a recording head while intermittently conveying the recording medium, the inkjet printer comprising:

a recording head having a plurality of nozzles for ejecting ink onto a recording medium from the plurality of nozzles;

a carriage having the recording head mounted therein, the carriage being reciprocable in a direction intersecting with a conveyance direction of the recording medium;

a platen for retaining the recording medium, the platen being arranged so as to be opposed to a lower surface side of the carriage;

a heater provided in the platen for heating the recording medium;

conveyance means for conveying the recording medium;

a housing having at least the carriage accommodated therein;

a housing suction fan for sucking a gas from an outside into an inside of the housing, the housing suction fan being arranged on a rear surface of the housing so as to be opposed to a rear surface of the carriage;

a rear surface exhaust fan for exhausting the gas inside the housing to the outside, the rear surface exhaust fan being arranged on the rear surface of the housing;

a side surface exhaust fan for exhausting the gas inside the housing to the outside, the side surface exhaust fan being arranged on a side surface of the housing;

a carriage suction fan for sucking the gas, which is sucked by the housing suction fan, into the carriage, the carriage suction fan being arranged on the rear surface of the carriage so as to be opposed to the housing suction fan;

a front paper guide for guiding and heating the recording medium, the front paper guide being arranged on a downstream side of the platen in the conveyance direction; and a cover arranged at a distance from the front paper guide and connected to the housing so that a distal end portion thereof is positioned lower in a vertical direction than a surface of the recording head on which the plurality of nozzles are arranged, wherein the housing suction fan has a height along the vertical direction which is larger than a height of the carriage suction fan along the vertical direction, wherein when the housing suction fan and the carriage suction fan are arranged at positions opposed to each other, the gas sucked by the housing suction fan is sucked into the carriage by the carriage suction fan and flows into the housing without being sucked by the carriage suction fan, wherein the gas, which is sucked into the carriage by the carriage suction fan, is discharged to the inside of the housing toward the cover, and wherein the gas sucked by the housing suction fan is at least discharged to the outside of the housing from the rear surface exhaust fan, the side surface exhaust fan, and a clearance between the front paper guide and the cover.

2. An inkjet printer according to claim 1, wherein a total suction amount per unit time by the housing suction fan to suck the gas from the outside of the housing is larger than a total exhaust amount obtained by summing an exhaust by the rear surface exhaust fan per unit time and an exhaust by the side surface exhaust fan per unit time, wherein a part of the gas sucked by the housing suction fan is discharged so as to pass through a portion between the front paper guide and the distal end of the cover, and wherein the cover is arranged so as to approach the front paper guide toward the distal end in order that the discharged gas is discharged in a direction along the front paper guide.

3. An inkjet printer according to claim 1, further comprising:

a rear paper guide for guiding the recording medium to an upstream side of the platen in the conveyance direction, and heating the recording medium; and a bending portion arranged at a position opposed to the rear paper guide, the bending portion being formed by bending a distal end of the housing, wherein the bending portion is arranged so as to approach the rear paper guide toward a distal end thereof, and wherein the distal end of the bending portion is arranged at a position lower than the platen in the vertical direction.

4. An inkjet printer according to claim 1, further comprising a maintenance unit including a cap for hermetically closing the recording head on a lateral part of the platen on the side surface exhaust fan side so that a volume of an empty space in the housing on a lateral part of the platen on the rear surface exhaust fan side is larger than a volume of an empty space in the housing on the lateral part on the side surface exhaust fan side.

5. An inkjet printer according to claim 1, further comprising a discharge port having an elongated hole shape and being formed so as to be elongated along a moving direction of the carriage in a lower end of the carriage on the downstream side in the conveyance direction, wherein a discharge direction for the discharge port is directed toward the cover, and wherein the gas inside the carriage, which is sucked by the carriage suction fan, is discharged toward the cover.

6. An inkjet printer according to claim 2, further comprising:

a rear paper guide for guiding the recording medium to an upstream side of the platen in the conveyance direction and for heating the recording medium; and a bending portion arranged at a position opposed to the rear paper guide, the bending portion being formed by bending a distal end of the housing, wherein the bending portion is arranged so as to approach the rear paper guide toward a distal end thereof, and wherein the distal end of the bending portion is arranged at a position lower than the platen in the vertical direction.

7. An inkjet printer according to claim 2, further comprising a maintenance unit including a cap for hermetically closing the ink jet head on a lateral part of the platen on the side surface exhaust fan side so that a volume of an empty space in the housing on a lateral part of the platen on the rear surface exhaust fan side is larger than a volume of an empty space in the housing on the lateral part on the side surface exhaust fan side.

8. An inkjet printer according to claim 3, further comprising a maintenance unit including a cap for hermetically closing the ink jet head on a lateral part of the platen on the side surface exhaust fan side so that a volume of an empty space in the housing on a lateral part of the platen on the rear surface exhaust fan side is larger than a volume of an empty space in the housing on the lateral part on the side surface exhaust fan side.

9. An inkjet printer according to claim 2, further comprising a discharge port having an elongated hole shape and being formed so as to be elongated along a moving direction of the carriage in a lower end of the carriage on the downstream side in the conveyance direction; wherein a discharge direction for the discharge port is directed toward the cover; and wherein the gas inside the carriage, which is sucked by the carriage suction fan, is discharged toward the cover.

10. An inkjet printer according to claim 3, further comprising a discharge port having an elongated hole shape and being formed so as to be elongated along a moving direction of the carriage in a lower end of the carriage on the downstream side in the conveyance direction; wherein a discharge direction for the discharge port is directed toward the cover; and wherein the gas inside the carriage, which is sucked by the carriage suction fan, is discharged toward the cover.

11. An inkjet printer according to claim 4, further comprising a discharge port having an elongated hole shape and being formed so as to be elongated along a moving direction of the carriage in a lower end of the carriage on the downstream side in the conveyance direction; wherein a discharge direction for the discharge port is directed toward the cover; and wherein the gas inside the carriage, which is sucked by the carriage suction fan, is discharged toward the cover.

12. An inkjet printer for recording an image on a recording medium, the inkjet printer comprising:

a housing;

a carriage accommodated in the housing;

a recording head mounted in the carriage for ejecting ink onto a recording medium to record an image;

a cover connected to the housing so that a distal end portion thereof is positioned lower in a vertical direction than a surface of the recording head;

at least one first suction fan arranged on a rear surface of the housing for sucking a gas from an outside into an inside of the housing;

a first exhaust fan for exhausting the gas inside the housing to the outside, the first exhaust fan being arranged on the rear surface of the housing;

a second exhaust fan for exhausting the gas inside the housing to the outside, the second exhaust fan being arranged on a side surface of the housing; and at least one second suction fan for sucking into the carriage the gas which is sucked by the first suction fan, the second suction fan being arranged on the rear surface of the carriage so as to be opposed to the first suction fan;

wherein the first suction fan has a height along the vertical direction which is larger than a height of the second suction fan along the vertical direction;

wherein when the first suction fan and the second suction fan are arranged at positions opposed to each other, the gas sucked by the first suction fan is sucked into the carriage by the second suction fan and flows into the housing without being sucked by the second suction fan;

wherein the gas which is sucked into the carriage by the second suction fan is discharged to the inside of the housing toward the cover; and wherein the gas sucked by the first suction fan is discharged to the outside of the housing from the first exhaust fan and the second exhaust fan.

13. An inkjet printer according to claim 12, further comprising a platen for retaining the recording medium, and a front paper guide for guiding and heating the recording medium, the front paper guide being arranged on a downstream side of the platen in a conveyance direction of the recording medium; wherein a total suction amount per unit time by the first suction fan to suck the gas from the outside of the housing is larger than a total exhaust amount obtained by summing an exhaust by the first exhaust fan per unit time and an exhaust by the second exhaust fan per unit time; wherein a part of the gas sucked by the first suction fan is discharged so as to pass through a portion between the front paper guide and the distal end of the cover; and wherein the cover is arranged so as to approach the front paper guide toward the distal end in order that the discharged gas is discharged in a direction along the front paper guide.

14. An inkjet printer according to claim 12, further comprising:

a platen for retaining the recording medium;

a rear paper guide for guiding the recording medium to an upstream side of the platen in a conveyance direction of the recording medium and for heating the recording medium; and a bending portion arranged at a position opposed to the rear paper guide, the bending portion being formed by bending a distal end of the housing;

wherein the bending portion is arranged so as to approach the rear paper guide toward a distal end thereof; and wherein the distal end of the bending portion is arranged at a position lower than the platen in the vertical direction.

15. An inkjet printer according to claim 12, further comprising a platen for retaining the recording medium, and a maintenance unit including a cap for hermetically closing the recording head on a lateral part of the platen on the side surface exhaust fan side so that a volume of an empty space in the housing on a lateral part of the platen on the rear surface exhaust fan side is larger than a volume of an empty space in the housing on the lateral part on the side surface exhaust fan side.

16. An inkjet printer according to claim 12, further comprising a discharge port having an elongated hole shape and being formed so as to be elongated along a moving direction of the carriage in a lower end of the carriage on a downstream side of the platen in a conveyance direction of the recording medium; wherein a discharge direction for the discharge port is directed toward the cover; and wherein the gas inside the carriage, which is sucked by the carriage suction fan, is discharged toward the cover.

17. An inkjet printer according to claim 12, wherein the at least one first suction fan comprises a plurality of first suction fans.

18. An inkjet printer according to claim 12, wherein the at least one second suction fan comprises a plurality of second suction fans.

* * * * *